United States Patent [19]

Schneider

[11] Patent Number: 5,035,008

[45] Date of Patent: Jul. 30, 1991

[54] LEISURE WEAR STOCKING

[76] Inventor: Sharron L. Schneider, 1479 Lennox St., North Vancouver, Canada, V7H 1X4

[21] Appl. No.: 478,965

[22] Filed: Feb. 12, 1990

[30] Foreign Application Priority Data

Sep. 29, 1989 [CA] Canada ..... 615321

[51] Int. Cl.[5] ..... A41B 11/00; A43B 17/00

[52] U.S. Cl. ..... 2/239; 2/242; 66/178 R; 66/183; 66/202

[58] Field of Search ..... 2/239, 242; D2/329, D2/331; 66/178 R, 183, 202

[56] References Cited

U.S. PATENT DOCUMENTS

| | | | |
|---|---|---|---|
| 32,603 | 4/1900 | Sutro | D2/329 |
| 183,257 | 7/1958 | Holder et al. | D2/329 |
| 186,398 | 1/1877 | Krauser | 66/178 R |
| 808,204 | 12/1905 | Kayser | D2/239 |
| 1,496,696 | 6/1924 | Wilcox | 66/178 R |
| 2,263,763 | 11/1941 | Edwards | 66/178 |
| 4,373,215 | 2/1983 | Guigley | 2/239 |

OTHER PUBLICATIONS

Speigel Catalog, Summer 1988, p. 182 (F).

J. C. Penney Catalog, Summer 1981, p. 411, Dress Socks.

Sears, Catalog, Spring 1983, p. 465. #11.

*Primary Examiner*—Werner H. Schroeder

*Assistant Examiner*—Gloria Hale

*Attorney, Agent, or Firm*—John Russell Uren

[57] ABSTRACT

A stocking for leisure wear which has a thin silk material used for a foot portion with a reinforced toe and heel. A lower leg portion of cotton knit material is attached to the foot portion at the ankle by sewing with thread. The lower leg portion is a heavy cotton knit which provides warmth to the leg of a user and has the appearance of a knit sock. The foot portion enables the sock to be worn with a leather shoe or boot without stretching the shoe or boot or squeezing or cramping the foot of the user.

13 Claims, 1 Drawing Sheet

FIG. 3
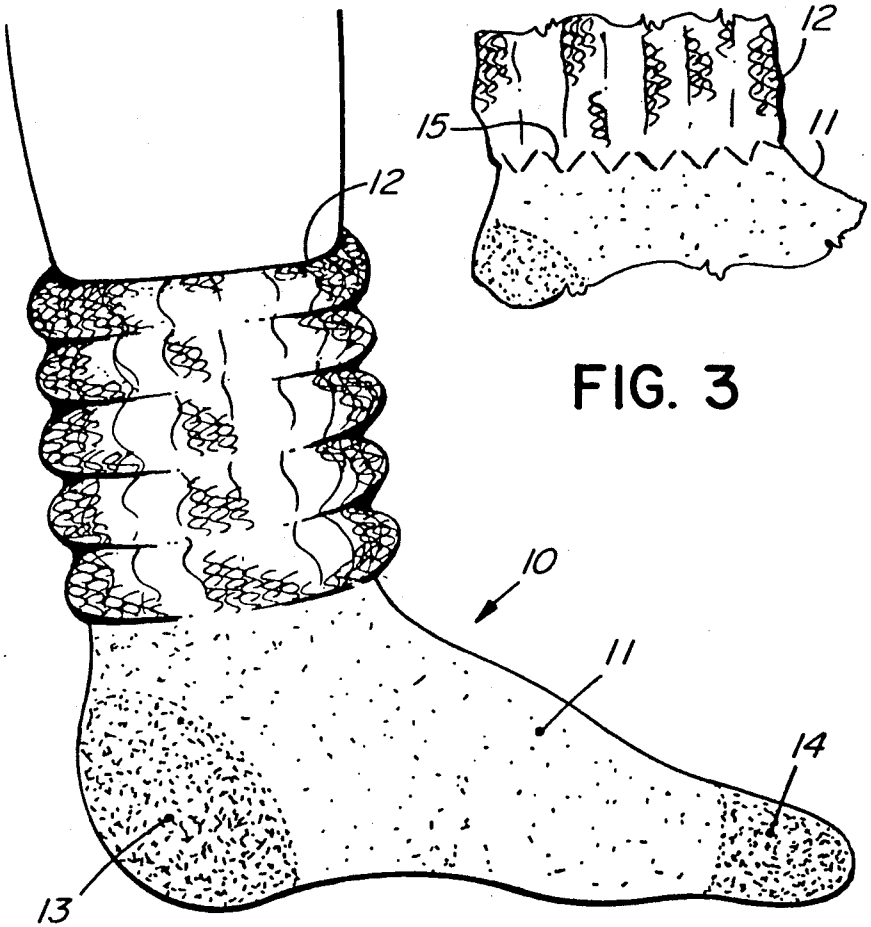
FIG. 2
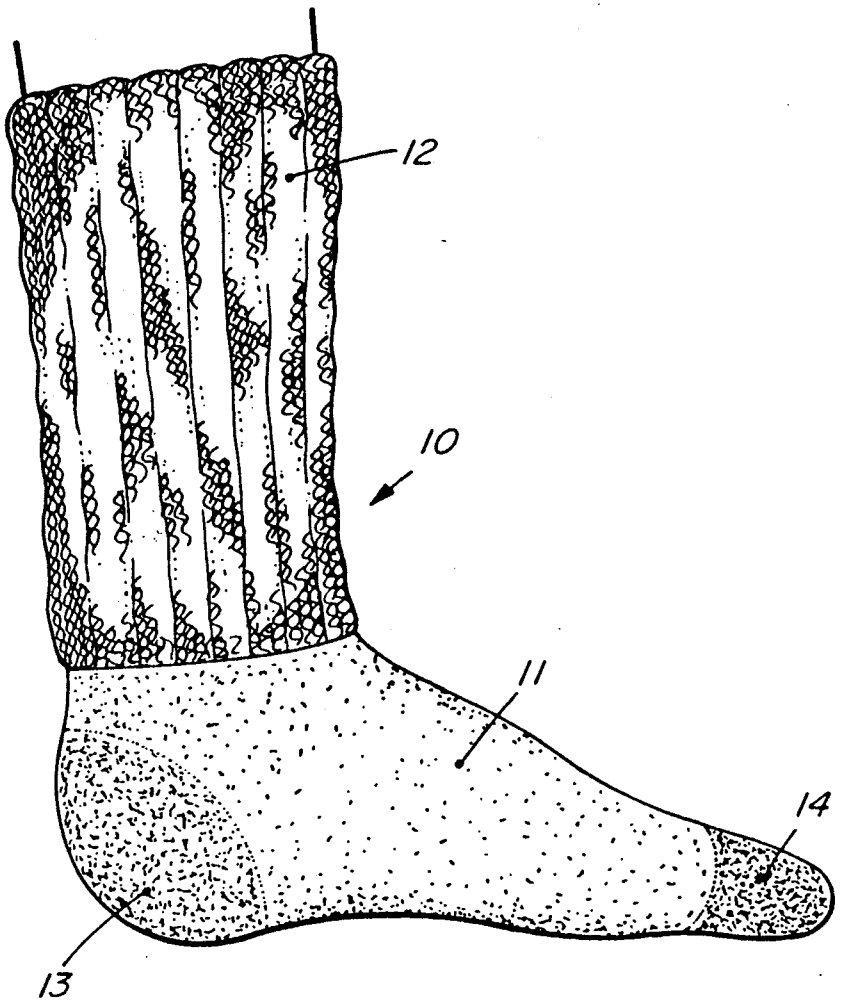
FIG. 1

LEISURE WEAR STOCKING

INTRODUCTION

This application relates to a stocking and, more particularly, to with cotton knit ankle portion and a nylon or spandex foot portion.

BACKGROUND OF THE INVENTION

There are, of course, many different stockings used in everyday activities. Such stockings take many forms and appearances, both by way of colour and by way of materials used in the different areas of the stocking.

One type of stocking used which is popular for leisure activities is a cotton knit stocking. Such a stocking provides warmth to the user and, as well, it has a fashionable appearance in leisure activities.

Such a stocking, however, has deficiencies. One such deficiency is that the stocking is relatively thick throughout its length. When such a stocking is worn with a shoe, it has a tendency to cramp or squeeze the foot of the wearer. This, of course, is uncomfortable and can actually cause injury to the foot of the wearer over time.

A further deficiency of such a stocking is that the foot portion, being relatively thick, can cause the shoe of the wearer to stretch. When the user wishes to wear the shoe with a thin stocking, the shoe will have a fit that is somewhat large on the foot of the wearer.

Yet a further deficiency of such a stocking is that the foot portion, being relatively thick and causing a squeezing of the foot, will cause the foot to perspire unnecessarily. This is uncomfortable.

A second type of stocking is one which is used for business or formal activities or with a good leather walking shoe which may be used particularly often for the elderly. This type of stocking is generally silk or nylon and does not provide warmth for the ankle and lower leg portion although it does have the advantage of a comfortable fit within the shoe with which the stocking is worn.

One stocking according to the prior art is the stocking illustrated in U.S. Pat. No. Des. 32,603 by Sutro. This stocking shows a half hose stocking with a foot portion having an unribbed fabric and a top portion being uniformly ribbed. The foot portion is not silk or nylon and the top portion is not cotton knit. While the foot portion is slightly thinner that the leg portion, there is no teaching than this is substantially so. Further there is no teaching in this patent that the leg portion may be pulled up or pushed down to a position lower on the leg and surrounding the ankle such as is the case with a sock known as a "slouch sock."

A slouch sock has a greater amount of material in the leg portion and it is more relaxed since there is no elastic material in the leg portion.

Yet a further sock is one illustrated in U.S. Pat. No. Des. 183,257 to Holder et al. This reference teaches a stocking with a plain knitted bottom and a ribbed top. It is not a slouch sock. Rather, it is a cotton sock having the inherent deficiency of the bulk of cotton for the foot portion.

Yet a further stocking is illustrated in U.S. Pat. No. 4,373,215 to Guigley. This reference teaches a tubular sock having a double thickness on the foot. This reference, however, is much different from the sock according to the present invention since thickness in the foot portion is undesirable as described heretofore.

Yet a further stocking is one shown in U.S. Pat. No. Des. 808,204 to Kayser. This reference teaches a stocking having a foot portion partially made from silk. The foot portion has a toe area that is reinforced by a material such as cotton for durability purposes. It does not teach a slouch sock nor a sock with a cotton upper portion.

SUMMARY OF THE INVENTION

According to the invention, there is disclosed a leisure stocking comprising a lower leg portion made from a cotton knit material and a foot portion made from silk and spandex material, said lower leg portion being a slouch portion and being operable to take a relaxed position on the leg of a user, said foot portion being a relatively thin portion, said lower foot portion being connected to said lower leg portion.

According to a further aspect of the invention, there is disclosed a leisure stocking comprising a lower leg portion made from a cotton knit material and a foot portion made from a combination of silk, nylon and spandex material, said lower leg portion being a slouch portion and being operable to take a relaxed position on the leg of a user, said foot portion being a relatively thin portion, said lower foot portion being connected to said lower leg portion.

According to yet a further aspect of the invention, there is disclosed a leisure stocking comprising a lower leg portion made from a cotton knit material and a root, portion made from a combination of nylon and spandex material, said lower leg portion being a slouch portion and being operable to take a relaxed position on the leg of a user, said foot portion being a relatively thin portion, said lower foot portion being connected to said lower leg portion.

BRIEF DESCRIPTION OF THE SEVERAL VIEWS OF THE DRAWINGS

A specific embodiment of the invention will now be shown, by way of example only, with the use of drawings in which:

FIG. 1 is a side view of the stocking according to the invention, with the leg portion of the stocking being worn in the up position;

FIG. 2 is a side view of the stocking with the leg portion of the stocking being worn in the down or slouch position; and FIG. 3 is a side view of stocking particularly showing the connection between the foot and lower leg portion of the stocking.

DESCRIPTION OF SPECIFIC EMBODIMENT

Reference is now made to the drawings wherein a stocking according to the invention is generally illustrated at 10. The stocking comprises a foot portion 11 and a leg portion 12 which is connected to the foot portion by sewing with thread 15 the foot and leg portions 11, 12, respectively, together as seen more clearly in FIG. 3.

The leg portion is a "slouch" type material. Such a material is known as a slouch type material if it has a knit fabric of 100% first grade cotton. Such a material also has little or no elastic present.

The foot portion can be made from several materials. It can be a combination of silk, nylon and spandex in combination or it could be nylon and LYCRA ® spandex in combination or it could use silk and spandex in combination. The foot portion is also very thin relative to the bulk of the leg or slouch portion of the sock but it has a reinforced heel area 13 and a toe area 14.

OPERATION

In operation, the user will pull the stocking 10 over the foot and leg portion until the foot portion 11 is snugly properly fitted. The user will then either raise or lower the slouch or leg portion 12 as desired.

The use of the very thin foot portion will cause a good fit for the foot within a shoe and will allow the circulation of air around the foot within the shoe. The use of the bulk knit cotton material for the leg portion will allow the user to have the warmth, comfort and style of the slouch portion of the stocking 10 without the uncomfortable feeling of the stocking 10 within a shoe that may cramp the foot and without stretching a shoe which would make the subsequent wearing of the shoe uncomfortably large due to the stretching by a sock having a foot portion of the same material as the leg or slouch portion.

It is contemplated that the leg portion 12 and the foot portion 11 of the stocking 10 will be of the same colour.

Many modifications will readily occur to those skilled in the art to which the invention relates and the specific embodiments described should be taken as illustrative of the invention only and not as limiting its scope as defined in accordance with the accompanying claims.

What is claimed is:

1. A leisure stocking comprising a foot portion which is of a relatively thin synthetic elastic textile fibre and a lower leg portion which is of a relatively thicker knitted fibrous material.

2. The leisure stocking according to claim 1, wherein the synthetic elastic textile fibre is selected from the group consisting of spandex and nylon.

3. The leisure stocking according to claim 1, wherein the synthetic elastic textile fibre comprises a combination of spandex and nylon.

4. The leisure stocking according to claim 1, wherein the synthetic elastic textile fibre is combined with a natural fibrous material.

5. The leisure stocking according to claim 4, wherein the natural fibrous material is silk.

6. The leisure stocking according to claim 1, wherein the knitted fibrous material is cotton.

7. The leisure stocking according to claim 1 wherein said lower leg portion is a slouch portion which is operable to take a relaxed position on the leg of a user.

8. The leisure stocking according to claim 7, wherein said foot portion and said leg portion have the same colour.

9. A leisure stocking comprising a foot portion which is a of a relatively thin synthetic elastic textile fibre, selected from the group consisting of nylon and spandex, and a lower leg portion which is of a relatively thicker cotton knit material.

10. The leisure stocking according to claim 9 wherein the synthetic elastic textile fibre is combined with a natural fibrous material.

11. The leisure stocking according to claim 10, wherein the natural fibrous material is silk.

12. The leisure stocking according to claim 9, wherein said lower leg portion is a slouch portion which is operable to take a relaxed position on the leg of a user.

13. The leisure stocking according to claim 12, wherein said foot portion and said leg portion have the same colour.

* * * * *